US006672940B1

(12) United States Patent
Graham

(10) Patent No.: US 6,672,940 B1
(45) Date of Patent: Jan. 6, 2004

(54) SURFACE POLISHING SLURRY COOLING SYSTEM

(75) Inventor: Andrew Graham, Sunol, CA (US)

(73) Assignee: Scratch Off, a division of Austin Graham, Inc., Sunol, CA (US)

( * ) Notice: Subject to any disclaimer, the term of this patent is extended or adjusted under 35 U.S.C. 154(b) by 0 days.

(21) Appl. No.: 10/055,419

(22) Filed: Jan. 22, 2002

(51) Int. Cl.[7] ..... B24B 49/00
(52) U.S. Cl. ..... 451/7; 451/53; 451/344
(58) Field of Search ..... 451/7, 53, 340, 451/344, 360

(56) References Cited

U.S. PATENT DOCUMENTS 4,622,780 A 11/1986 Tingley
4,709,513 A 12/1987 Tingley
5,104,828 A * 4/1992 Morimoto et al. ..... 438/633
5,127,196 A * 7/1992 Morimoto et al. ..... 451/7
5,157,269 A * 10/1992 Jordan et al. ..... 307/59
5,458,770 A * 10/1995 Fentz ..... 210/168
5,632,667 A * 5/1997 Earl et al. ..... 451/41
5,835,000 A * 11/1998 Ascroft et al. ..... 336/90
6,000,997 A * 12/1999 Kao et al. ..... 451/7
6,416,384 B1 * 7/2002 Kawamoto et al. ..... 451/7

* cited by examiner

*Primary Examiner*—Lee D. Wilson
*Assistant Examiner*—David B. Thomas
(74) *Attorney, Agent, or Firm*—Blakely, Sokoloff, Taylor & Zafman LLP

(57) ABSTRACT

A system for cooling a slurry compound used during polishing and grinding is disclosed. In one embodiment, the system includes a cooling module, such as a refrigeration unit, connected to a heat-transfer device, such as a metal coil. The cooling module cools the heat-transfer device. The heat-transfer device cools the slurry compound.

21 Claims, 5 Drawing Sheets

SURFACE POLISHING SLURRY COOLING SYSTEM

BACKGROUND OF THE INVENTION

1. Field of the Invention

The present invention relates generally to the field of surface grinding and polishing and, more specifically, to a system for cooling a slurry compound used during polishing and grinding.

2. Discussion of Related Art

Surface polishing, such as the removal of scratches from glass, is currently accomplished by polishing systems that use various rotary tools and slurry compounds. One such system is described in the Tingley invention, U.S. Pat. No. 4,622,780 ("Tingley"). Tingley describes a hand-held rotary tool and a slurry container. The slurry container includes a pump that pumps a slurry compound onto the rotary tool as it grinds or polishes the surface.

Current systems, such as Tingley, however generate unwanted heat by the friction of the polishing rotary tool, by the pump inside the slurry container, or other powered elements in the system. The heat is transferred to the slurry as it circulates through the polishing system. As the temperature of the slurry rises, however, ill effects occur. For instance, as the temperature of the slurry compound rises, the polishing effectiveness of the slurry decreases. Catalysts within the slurry, such as cerium oxide, are intended to chemically react with, and consequently soften, the glass, making it easier to polish. However, when the polishing slurry temperature rises over a certain level, the chemical reaction with the catalyst slows down and the slurry loses its polishing effectiveness by over 50%.

Another ill effect caused by hot slurry compound is that as the temperature in the slurry rises, the polishing tool gets hot. The heat from the tool can distort the appearance of many surfaces, such as glass, leaving an unattractive warped or wavy result. The user must then stop work to wait for the slurry compound and the tool to cool down, thus leading to wasted time.

Therefore, because of the disadvantages of hot slurry compound, a system is needed that can cool slurry compound as it circulates through a grinding or polishing system.

BRIEF DESCRIPTION OF THE DRAWINGS

The present invention is illustrated by way of example and not limited by the figures of the accompanying drawings in which like references indicate similar elements and in which.

SUMMARY OF THE INVENTION

A system is disclosed, including an apparatus and method for cooling a slurry compound used during polishing and grinding. In one embodiment, the system includes an apparatus with a cooling module and a heat-transfer device. The cooling module cools the heat-transfer device, while the heat-transfer device cools the slurry compound.

Other features of the present invention will be apparent from the accompanying drawings and from the detailed description that follows.

DETAILED DESCRIPTION OF THE INVENTION

Disclosed is a novel surface polishing slurry cooling system. In the following description numerous specific details are set forth in order to provide a through understanding of the present invention. One of ordinary skill in the art, however, will appreciate that these specific details are not necessary to practice the present invention. While certain exemplary embodiments have been described and shown in the accompanying drawings, it is to be understood that such embodiments are merely illustrative and not restrictive of the current invention, and that this invention is not restricted to the specific constructions and arrangements shown and described since modifications may occur to those ordinarily skilled in the art.

Figure 1:
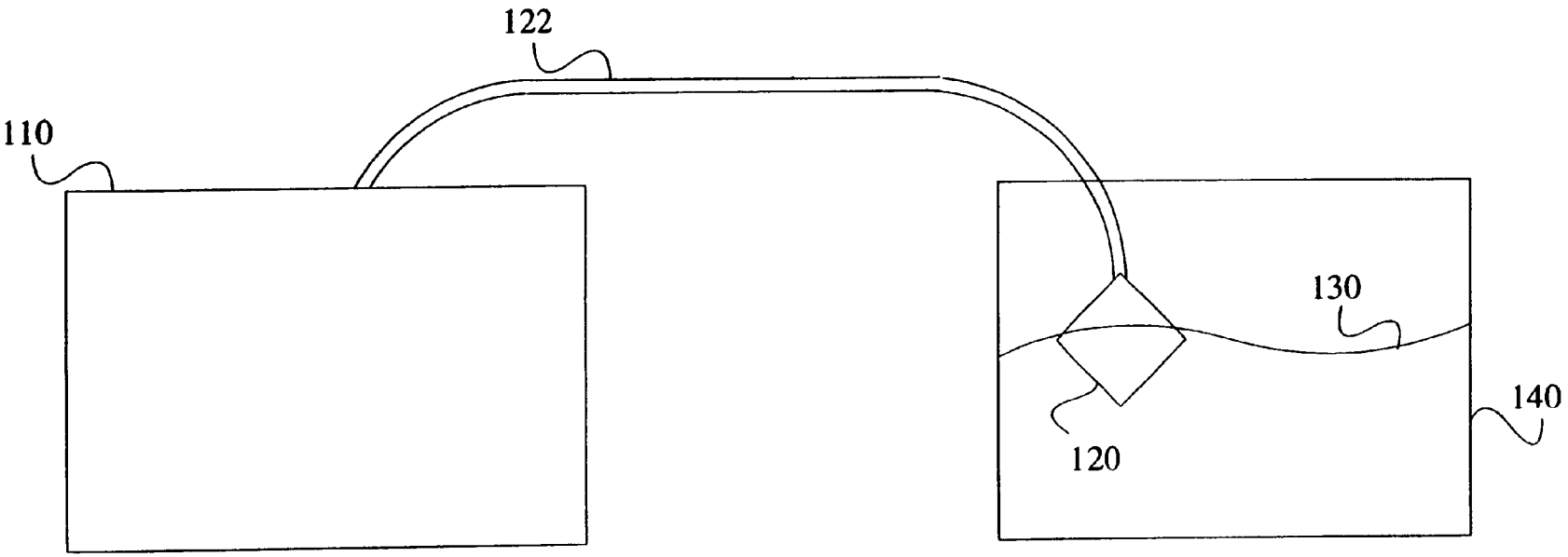
FIG. 1 is a diagram of one embodiment of a cooling system according to the present invention.

FIG. 1 is a diagram of a cooling system 100 according to one embodiment of the present invention. Referring to FIG. 1, the cooling system 100 includes a cooling module 110 connected to a heat-transfer device 120 via a line 122. The heat-transfer device is to extract thermal energy, or heat, from the slurry compound when the slurry compound 130 comes in thermal proximity to the heat-transfer device 120. The slurry compound 130 rests inside a container 140.

Cooling module 110 can be one of various types of devices. For instance, in one embodiment the cooling module 110 may be a refrigeration cooler. In another embodiment the cooling module 110 may be a gas or propane cooler. In another embodiment, the cooling module 110 may be an electric cooler, or peltier cooler. Furthermore, in yet another embodiment, the cooling module 110 may be a chemical cooler.

In one embodiment, the cooling module 110 is to provided coolant to the heat-transfer device 120. The coolant may vary depending on the cooling module 110. Exemplary coolants for refrigeration coolers include liquid ammonia, dichlorodifluoromethane, or a variety of gaseous or liquid fluorinated hydrocarbons, like Freon. Chemical coolers may use a combination of water and ammonium-nitrate fertilizer that create an endothermic reaction when mixed. Peltier coolers, on the other hand, do not use liquid coolants, but instead use electrons, to create a thermoelectric effect.

FIGS. 2*a*–2*f* are diagrams of various embodiments of heat-transfer devices 120 and containers 140 according to the present invention. The shape of the heat-transfer device 120 may vary depending on factors such as the shape of the container 140 or the position of the slurry compound 130 inside the container 140. For instance, in the embodiment shown in FIG. 2*a*, the heat-transfer device 120 is a circular shape in combination with a cylindrical container 140. In another embodiment, shown in FIG. 2*b*, the heat-transfer device 120 is a cylindrical shape in combination with a cubical container 140. In yet another embodiment, shown in FIG. 2*c*, the heat-transfer device 120 is an irregular shape in combination with an irregularly shaped container 140.

Figure 2A:
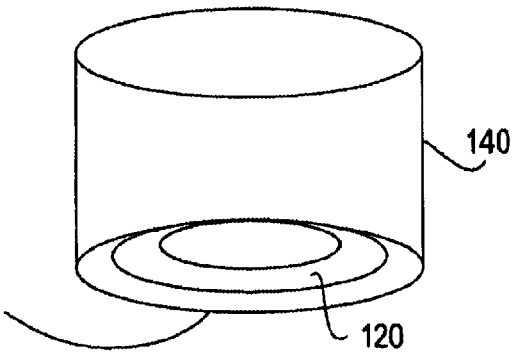
FIGS. 2*a*–2*f* are diagrams of various embodiments of heat-transfer devices and containers that may be used in the present invention.
Figure 2B:
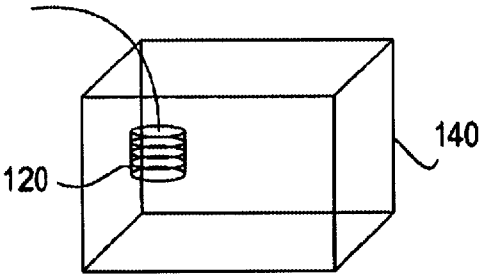
Figure 2C:
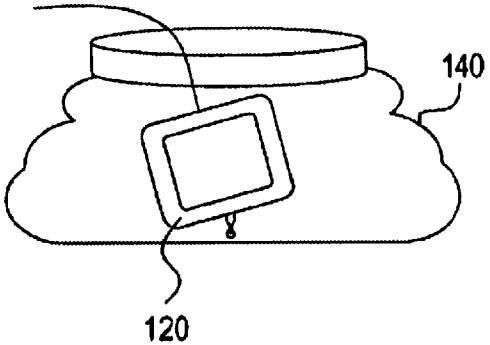
Figure 2D:
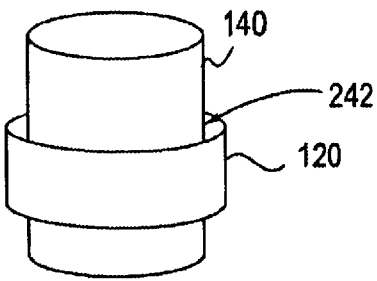
Figure 2E:
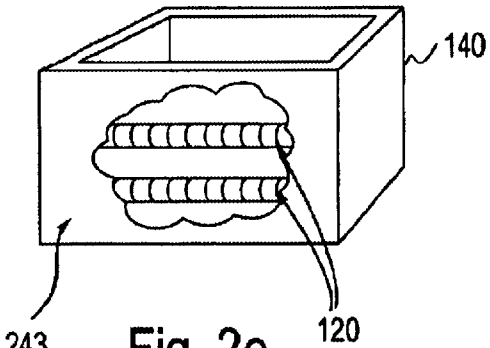
Figure 2F:
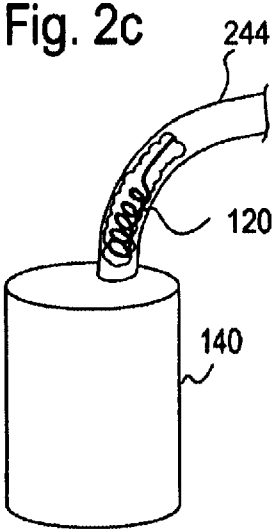

The position of the heat-transfer device 120 can vary. In one embodiment, the heat-transfer device is independent from the container 140, thus freely extractable and immersible, as shown in FIG. 2*b*. In another embodiment, shown in FIG. 2*d*, the heat-transfer device 120 is external to, but in close proximity to, the container 140, to cool the container wall 242, which in turn can cool the slurry compound 130. In one embodiment, the heat-transfer device may be integral with the container 140. For instance, shown in the cut-away view in FIG. 2*e*, the heat-transfer device 120 is contained inside the container wall 243. In another embodiment, shown in the cut-away view in FIG. 2*f*, the heat-transfer device 120 is inside a tube 244 external to the container 140, to cool the slurry compound 130 as it enters or exits the container 140.

Figure 3:
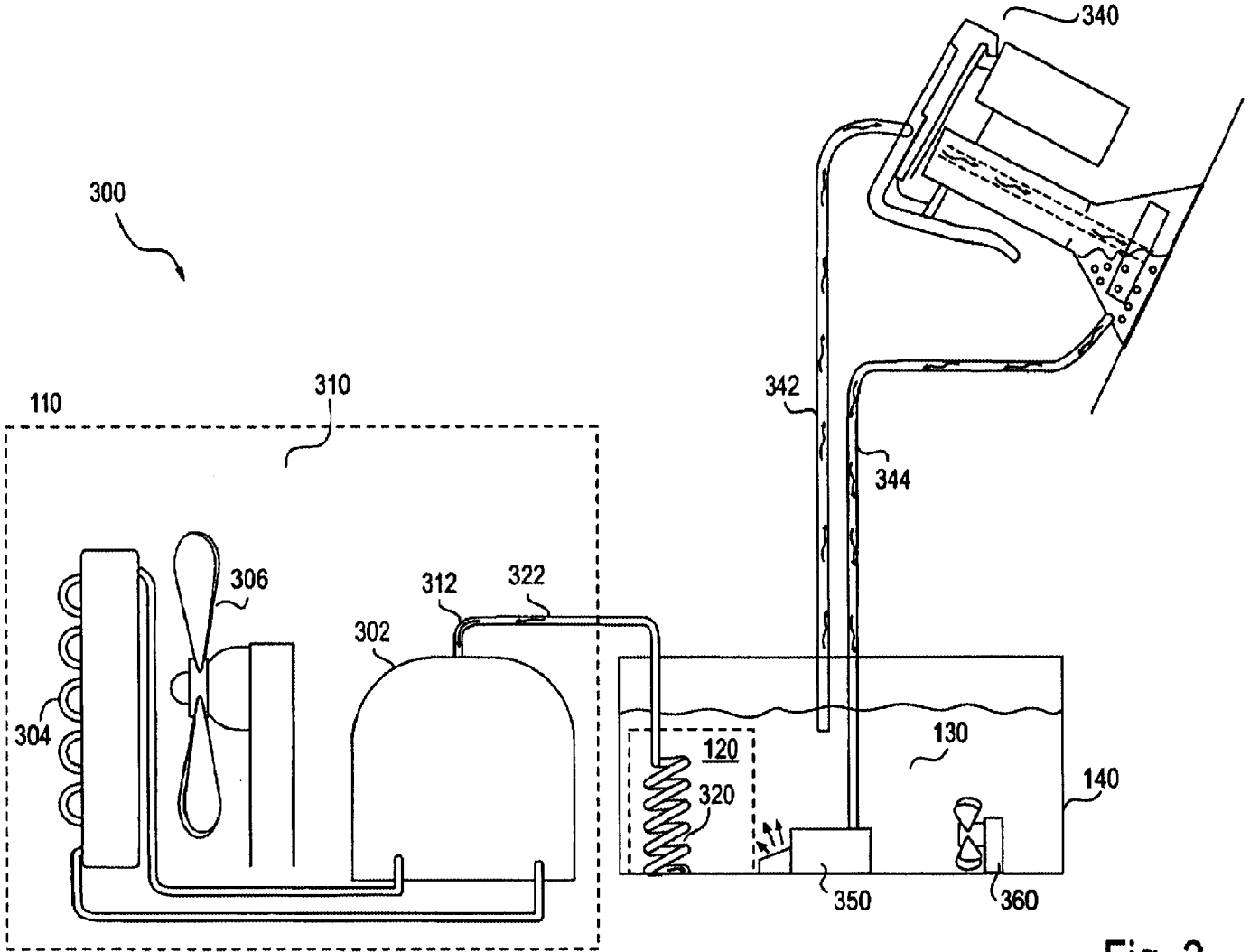
FIG. 3 is a diagram of a cooling system according to one embodiment of the present invention.

FIG. 3 is a diagram of a cooling system 300 according to one embodiment of the present invention. Referring to FIG. 3, the cooling module 110 is a liquid-coolant cooler 310 and the heat-transfer device 120 is a metal coil 320. In one embodiment, the liquid-coolant cooler 310 includes a pump 302 to pump a liquid coolant 312 through a circulating line 322, an internal heat-exchange coil 304, and a fan 306 to blow air through the heat-exchange coil 304 to cool the circulating liquid coolant 312 inside the heat-exchange coil 304. In one embodiment, heat-exchange coil 304, may further include a tubulator inserted inside the coil tubing to increase the turbulence flow of the liquid coolant 312. In one embodiment, the metal coil 320 is freely immersible in the slurry compound 130, to come in physical contact with-the-slurry compound 130 and to extract heat from it. The coil shape of the metal coil 320 is advantageous because of its large surface area to volume ratio, thus providing excellent heat transferring properties. In one embodiment, a polisher/grinder tool 350 extracts slurry compound 130 from the container 140 via output line 342 and input line 344. In one embodiment, a slurry pump 350 assists the polisher/ grinder tool 350 in extracting the slurry compound 130. In one embodiment, an agitator 360 may be employed to stir up the slurry compound.

Figure 4:
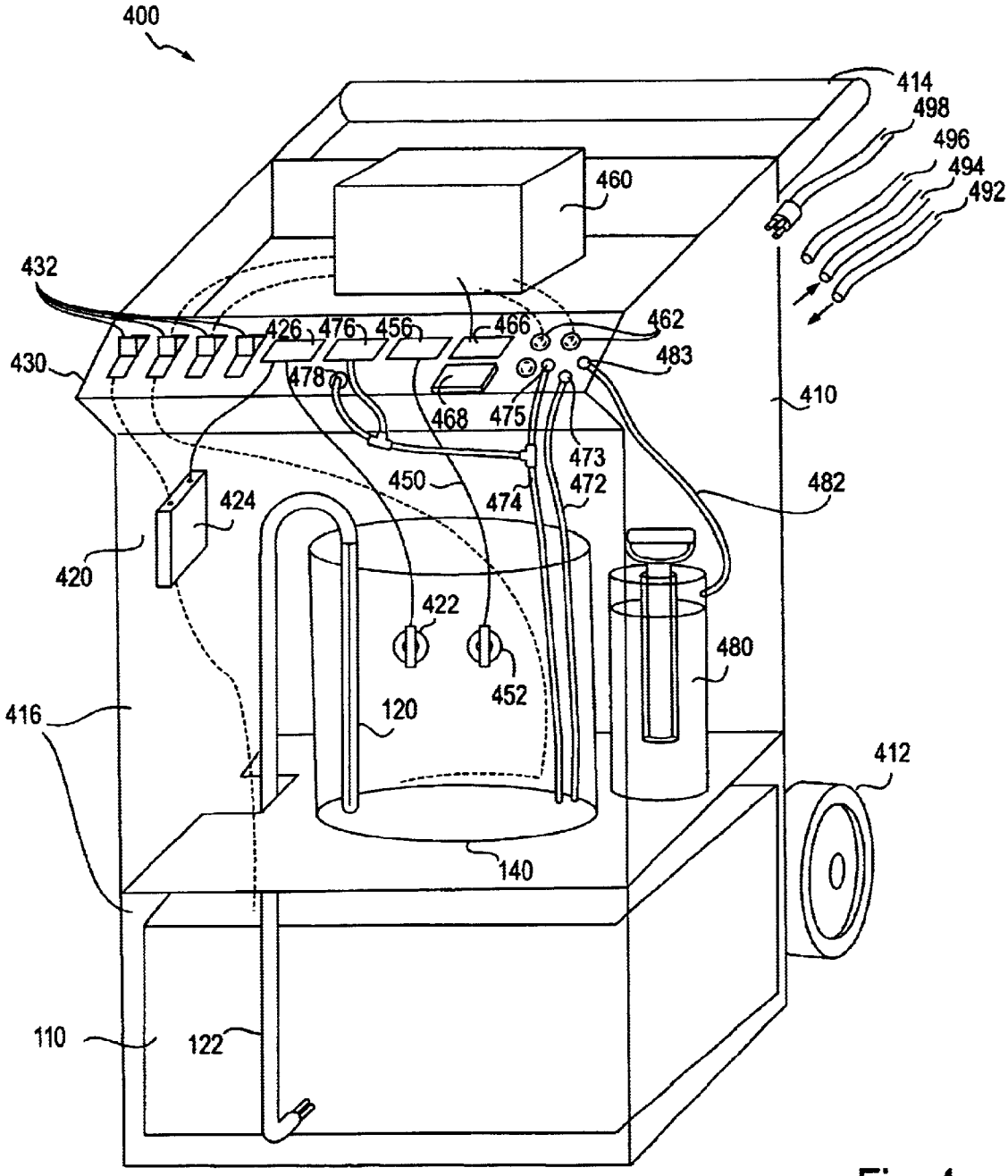
FIG. 4 is a diagram of one embodiment of a cooling system according to the present invention.

FIG. 4 is a diagram of one embodiment of a cooling system 400 according to the present invention. Referring to FIG. 4, the cooling system 400 includes a cooling module 110 to provide coolant to a heat-transfer device 120 via a circulating line 122, and a container 140 for holding a polishing slurry compound.

In one embodiment, the cooling system 400 includes a framework 410. In one embodiment, the framework is portable, including portable elements such as wheels 412 and a handle 414. A portable framework is advantageous to add transportability and mobility to the system, thus improving access to all types of surfaces in need of polishing. As a consequence of the portability of the framework 410, the slurry compound may shift around in its container 140. Therefore, in one embodiment, the container 140 is sealable, or otherwise able to self-contain the slurry compound when the system is mobile.

In one embodiment, the framework 410 includes compartments 416 for holding the cooling module 110, container 140, and heat-transfer device 120. In one embodiment, the framework 410, further includes a control panel 430 to control and display elements of various embodiments of the cooling system 400, to be described further below.

In one embodiment, the cooling system 400 includes a temperature control module 420 to monitor and control the temperature of the slurry compound. The temperature control module 420, in one embodiment, includes a temperature sensor 422 to monitor the temperature of the slurry compound. The temperature control module 420 may further include, in one embodiment, a temperature controller 424 connected to the cooling module 110 and to the temperature sensor 422, to receive temperature signals from the temperature sensor 422 and to control the function of the cooling module 110 according to the temperature of the slurry compound. The temperature control module 420 may further include, in one embodiment, a temperature display gauge 426, mounted on the control panel 430, to show the temperature of the slurry compound.

In one embodiment, the cooling system 400 includes a ph sensor module 450 to monitor the chemical composition of the slurry compound. In time, chemical particles of the slurry compound 130 wear out causing the alkaline level in the bucket to increase (i.e. making the slurry more acidic). A ph sensor, therefore, is advantageous to monitor the lifetime of the slurry compound. In one embodiment, the ph sensor module 450 includes a ph sensor 452 and display gauge 456 mounted on the display panel 430.

In one embodiment, the cooling system 400 includes a power module 460. The power module 460 can be used to power the cooling module 110 and affixed grinding or polishing tools (as shown in FIG. 3). In one embodiment, external electrical connectors 462 on the framework 410, are coupled to the power module 460. A power cord 498, from grinding or polishing tool, can engage an electrical connector 462 and receive power from power module 460. In one embodiment, an external current gauge 466 can display the current drawn from the any one of powered cooling system elements, such as a grinding or polishing tool, or cooling module 110. In one embodiment, a warning system 468 is coupled to the external current gauge 466, to indicate when current drawn is exceeding a predetermined level. The warning system 468 may include a shut down function, if the current exceeds predetermined levels.

In one embodiment, the cooling system 400 includes an output line 474 for transporting slurry compound out of the container 140 and an input line 472 for transporting slurry compound back into the container 140. In one embodiment, the output line 474 is connected to an output valve connector 475 on the framework 410 and the input line 472 is coupled to an input valve connector 473 on the framework 410. Input and output valve connectors 475, 473, can connect to external lines 494,492 leading to grinding and polishing tools. In one embodiment, the output line 474 is connected to a pressure gauge 476, on the framework 410, to show the vacuum pressure inside the output line 474. In one embodiment, a bleed valve 478 is connected to output line 474 to adjust the pressure inside the output line 474.

In one embodiment, the cooling system 400 includes a pressurized water vessel 480 with a water line 480 coupled to the framework 410.

Method

Figure 5:
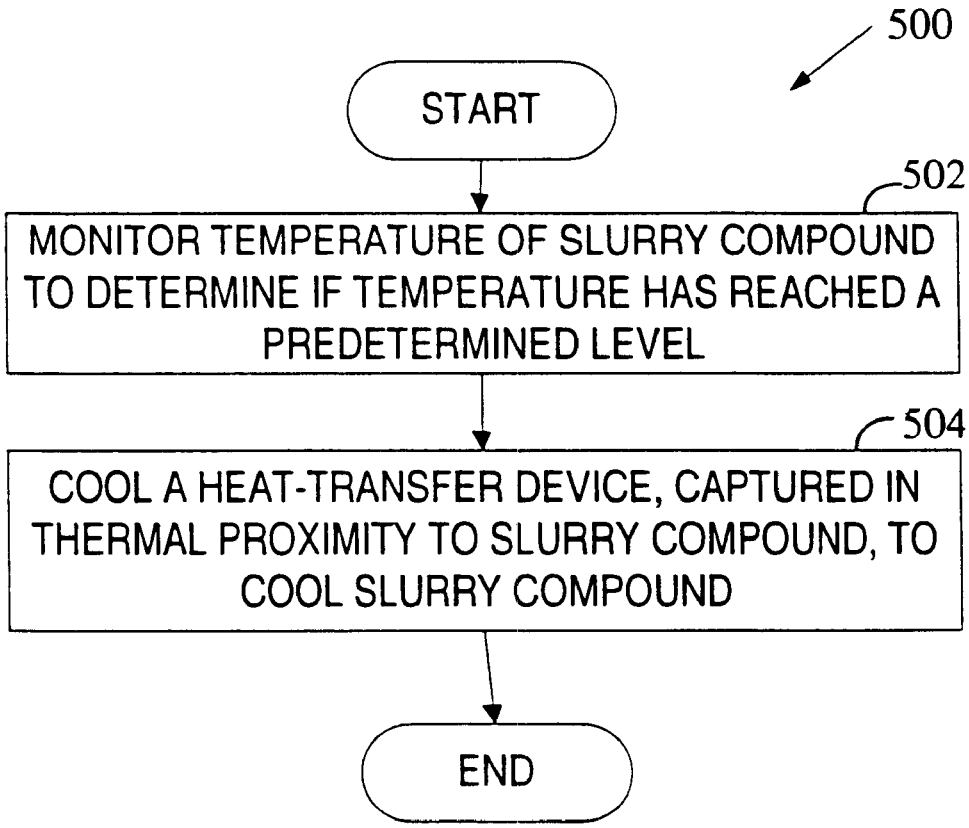
FIG. 5 is a flow diagram of one embodiment of a method for cooling a slurry compound according to the present invention.

FIG. 5 is a flow diagram of one embodiment of a method 500 for cooling a slurry compound according to the present invention. Method 500 begins, at processing block 502, with monitoring the temperature of a slurry compound to determine if the temperature of the slurry compound has reached a predetermined level. Method 500, continues, at processing block 504, with cooling a heat-transfer device, captured in thermal proximity to the slurry compound, to cool the slurry compound.

What is claimed:

1. An apparatus comprising:

a container to hold a surface polishing slurry compound that is to be circulated;

a heat-transfer device captured in thermal proximity to the container to cool the surface polishing slurry compound when the surface polishing slurry compound circulates to the container, and a cooling module connected to the heat-transfer device, the cooling module to cool the heat-transfer device as the heat-transfer device cools the surface polishing slurry compound.

2. The apparatus of claim 1, wherein the cooling module comprises coolant and a circulating line to transport the coolant and the heat-transfer device is connected to the end of the circulating line, to receive said coolant.

3. The apparatus of claim 1, further comprising a hand-held surface polishing tool including an output line from which to extract surface polishing slurry compound from the container and an input line to return surface polishing slurry compound to the container to be cooled.

4. The apparatus of claim 1, wherein the heat-transfer device is integral with the container.

5. The apparatus of claim 1, wherein the heat-transfer device is a metal coil.

6. The apparatus of claim 1, further comprising a temperature control module, to monitor and control the temperature of said slurry compound.

7. The apparatus of claim 6, wherein the temperature control module comprises:

a temperature sensor, to monitor the temperature of the slurry compound; and a temperature controller connected to the cooling module and temperature sensor, to receive temperature signals from the temperature sensor and to control the function of the cooling module according to the temperature of the slurry compound.

8. The apparatus of claim 1, further comprising a ph sensor module to monitor the lifetime of the slurry compound.

9. The apparatus of claim 1, further comprising a portable framework containing the container, the heat-transfer device, and the cooling module.

10. An apparatus, comprising:

a hand-held surface polishing tool;

a container to hold a surface polishing slurry compound, the surface polishing slurry compound to be circulated from the container through the hand-held surface polishing tool and back to the container;

a heat-transfer device captured in thermal proximity to the container to cool the surface polishing slurry compound when the surface polishing slurry compound circulates back to the container;

a cooling module connected to a heat-transfer device to cool the heat-transfer device, the cooling module including coolant to be circulated between the cooling module and the heat-transfer device through a circulating line; and a portable framework to hold the container, the heat-transfer device, and the cooling module.

11. The apparatus of claim 10 wherein the portable framework comprises wheels, a handle, and a plurality of compartments to hold the cooling module, heating device, and container.

12. The apparatus of claim 10 further comprising:

a power module;

an electrical connector on the framework, coupled to the power module; and a current gauge connected to the framework, coupled to the power module, to monitor current.

13. The apparatus of claim 12, further comprising a warning system coupled to the current gauge, to indicate when current drawn is exceeding a predetermined level.

14. The apparatus of claim 10, further comprising an output line to transport slurry compound out of the container and an input line to transport slurry compound back into the container, wherein the output line and input line are coupled to valve connectors on the framework.

15. The apparatus of claim 14 further comprising:

a circulation pump to pump the slurry compound out of the container, said output line connected to the circulation pump; and an agitator to agitate the slurry compound inside the container.

16. The apparatus of claim 14, further comprising a pressure gauge and a bleed valve, said pressure gauge and bleed valve coupled to the output line and mounted on the framework, wherein the bleed valve is to adjust the pressure within the output line.

17. The apparatus of claim 10, further comprising a pressurized water vessel with a water line coupled to the framework.

18. A method comprising:

transporting a surface polishing slurry compound, to be circulated, from a portable container, to a surface polishing tool;

polishing a surface with the surface polishing tool utilizing the surface polishing slurry compound to cool the surface during polishing, the surface polishing slurry compound thus becoming heated;

transporting the heated surface polishing slurry compound out of the surface polishing tool to the portable container;

monitoring the temperature of the surface polishing slurry compound to determine if the temperature of the surface polishing slurry compound has reached a predetermined level; and cooling the polishing slurry compound when the heated polishing slurry compound is transported to the portable container by capturing heat from the slurry compound via a heat-transfer device, captured in thermal proximity to the surface polishing slurry compound.

19. The method of claim 18, further comprising:

cooling the heat-transfer device by circulating a coolant via a circulating line connected to the heat-transfer device.

20. The method of claim 18, wherein the surface is glass and the polishing slurry compound includes cerium oxide.

21. The apparatus of claim 10, wherein the hand-held surface polishing tool is a rotary, glass polishing tool.

* * * * *